US008907751B2

(12) United States Patent
Borgwardt et al.

(10) Patent No.: US 8,907,751 B2
(45) Date of Patent: Dec. 9, 2014

(54) POWER CIRCUIT BREAKER

(71) Applicants: Andre Borgwardt, Schönwalde-OT Paaren (DE); Thomas Driehorn, Berlin (DE); Peter Kopaczewski, Berlin (DE); Andreas Krauβ, Berlin (DE); Aron-Ernst Musiol, Mahlow (DE); Gerd Müller, Falkensee (DE)

(72) Inventors: Andre Borgwardt, Schönwalde-OT Paaren (DE); Thomas Driehorn, Berlin (DE); Peter Kopaczewski, Berlin (DE); Andreas Krauβ, Berlin (DE); Aron-Ernst Musiol, Mahlow (DE); Gerd Müller, Falkensee (DE)

(73) Assignee: Siemens Aktiengesellschaft, Munich (DE)

( * ) Notice: Subject to any disclaimer, the term of this patent is extended or adjusted under 35 U.S.C. 154(b) by 42 days.

(21) Appl. No.: 13/721,107

(22) Filed: Dec. 20, 2012

(65) Prior Publication Data

US 2013/0162378 A1 Jun. 27, 2013

(30) Foreign Application Priority Data

Dec. 22, 2011 (DE) ..... 10 2011 089 631

(51) Int. Cl.

| | |
|---|---|
| ***H01H 9/00*** | (2006.01) |
| ***H01H 83/00*** | (2006.01) |
| ***H01H 75/12*** | (2006.01) |
| ***H01H 77/06*** | (2006.01) |
| ***H01H 83/04*** | (2006.01) |
| ***H01H 71/12*** | (2006.01) |

(52) U.S. Cl.

CPC ..... *H01H 77/06* (2013.01); *H01H 83/04* (2013.01); *H01H 71/123* (2013.01)

USPC ..... 335/174; 335/21; 335/35; 335/172; 335/173; 361/93.2; 361/93.6

(58) Field of Classification Search

CPC ..... H02H 3/044

USPC ..... 335/21, 35, 172–174; 361/93.2, 93.6

See application file for complete search history.

(56) References Cited

U.S. PATENT DOCUMENTS

| | | | | |
|---|---|---|---|---|
| 4,259,706 | A | 3/1981 | Zocholl | |
| 4,829,147 | A * | 5/1989 | Schiefen et al. | 200/17 R |
| 4,884,164 | A * | 11/1989 | Dziura et al. | 361/97 |

(Continued)

FOREIGN PATENT DOCUMENTS

| | | | |
|---|---|---|---|
| CN | 1401153 | A | 3/2003 |
| CN | 101770877 | A | 7/2010 |

OTHER PUBLICATIONS

Office Action for corresponding Chinese patent application No. 201210599314.9 dated Aug. 25, 2014 with English translation.

*Primary Examiner* — Mohamad Musleh

(74) *Attorney, Agent, or Firm* — Harness, Dickey & Pierce, P.L.C.

(57) ABSTRACT

A power circuit breaker is disclosed wherein an electric current is monitored by an electronic trip unit in order to detect an electrical fault. In an embodiment, a first magnetic device of the power circuit breaker, in the event of a fault being detected, is configured to be excited which, when it is excited, trips a trip mechanism via a plunger. As a result of tripping, the trip mechanism disconnects two contacts via which the current flows. The power circuit breaker of an embodiment includes a second magnetic device which is likewise able to be excited by the ETU and by which the trip mechanism is likewise able to be tripped.

8 Claims, 1 Drawing Sheet

(56) References Cited

U.S. PATENT DOCUMENTS

| | | | | | |
|---|---|---|---|---|---|
| 5,089,796 | A * | 2/1992 | Glennon et al. | 335/172 |
| 5,163,175 | A * | 11/1992 | Mori et al. | 335/132 |
| 5,252,933 | A * | 10/1993 | Kamino et al. | 335/172 |
| 5,596,472 | A * | 1/1997 | Roehl | 361/93.6 |
| 5,684,443 | A * | 11/1997 | Runyan et al. | 335/177 |
| 5,886,604 | A * | 3/1999 | Kume | 335/172 |
| 6,218,921 | B1 * | 4/2001 | Eberts et al. | 335/176 |
| 6,356,426 | B1 * | 3/2002 | Dougherty | 361/102 |
| 6,437,954 | B1 | 8/2002 | Harr | |
| 6,552,884 | B2 * | 4/2003 | Kim et al. | 361/42 |
| 7,619,866 | B2 * | 11/2009 | Houbre et al. | 361/93.2 |
| 8,139,328 | B2 * | 3/2012 | DiSalvo et al. | 361/42 |
| 8,207,804 | B2 * | 6/2012 | Ohtsuka et al. | 335/174 |
| 2007/0126538 | A1 * | 6/2007 | Liu | 335/172 |

* cited by examiner

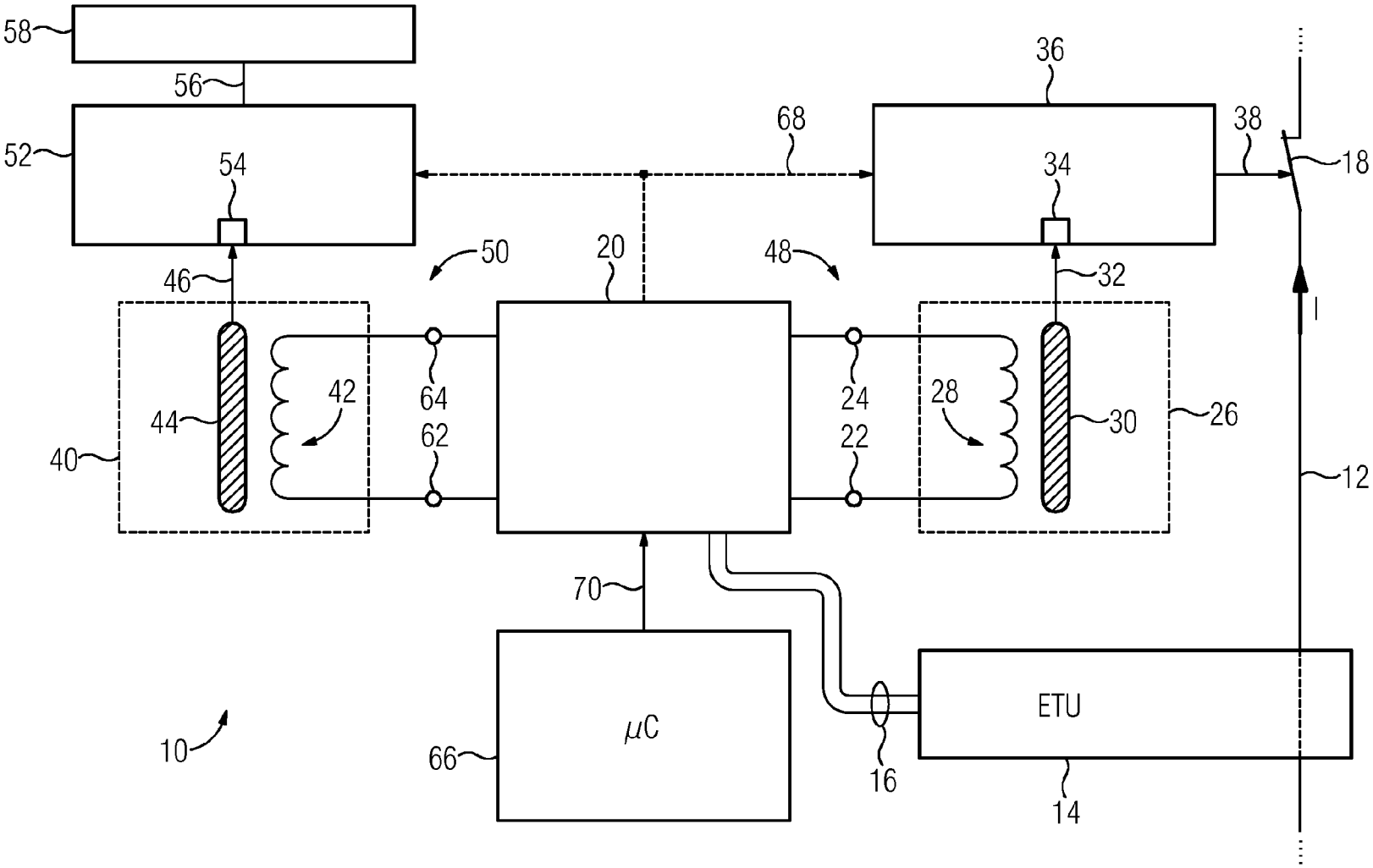
18
12
I
38
26
36
34
32
30
ETU
14
28
16
24
22
68
48
20
70
μC
50
64
62
66
42
54
56
46
44
10
58
52
40

POWER CIRCUIT BREAKER

PRIORITY STATEMENT

The present application hereby claims priority under 35 U.S.C. §119 to German patent application number DE 10 2011 089 631.7 filed Dec. 22, 2011, the entire contents of which are hereby incorporated herein by reference.

FIELD

At least one embodiment of the invention generally relates to a power circuit breaker for switching off an electric current in the event that an absolute value for the current intensity of the current or a temporal profile of the current intensity no longer has the desired properties owing to an electrical fault. In one particular embodiment, the power circuit breaker is a low-voltage power circuit breaker.

BACKGROUND

A power circuit breaker is sold, for example, by Siemens AG under the product name SENTRON 3WL. A safety device of this type serves to protect personnel, systems and equipment. The trip function for interrupting the power flow is generally realized by way of an actuating magnet. This magnetic device can be an electrical coil in which a ferromagnetic rod or plunger is placed. The coil, as a result of being energized, becomes excited and thus generates a magnetic field which drives the plunger out of the coil. Generally, the plunger is held in the coil against a spring force by means of a permanent magnet, with the result that, as a result of the electrical coil being excited, only a short force impulse must be generated in order then to push the plunger out of the magnetic device with the help of the spring.

The functional capability of the power circuit breaker depends, inter alia, on the magnetic device functioning faultlessly. If the power supply lines for the electrical coil are interrupted, if there is a short circuit in the trip circuit or else if there are mechanical problems, such as the plunger being jammed or frozen, the protection device will not work.

In order to monitor the operational capability or to detect possible faults, the magnetic device therefore is subjected to cyclical tests. For this purpose, the power circuit breaker is brought out of the operation mode and into a test mode, in which, however, it cannot then interrupt any current in the event of an electrical fault. In other words, the part of the system which is protected by the power circuit breaker must be switched off or be fed with current by a parallel branch. An on-line test, that is to say during operation of the power circuit breaker, is only known in connection with the electrical parameters of the magnetic device, for instance a continuity test or a measurement of the impedance of the coil. A complete test of the magnetic unit, that is to say including the mechanical functionality, in the course of operation is not possible.

SUMMARY

At least one embodiment of the present invention resides in ensuring a reliable operation of a power circuit breaker.

At least one embodiment is directed to a power circuit breaker. Advantageous developments of the power circuit breaker of the invention are given in the dependent claims.

In the power circuit breaker of at least one embodiment of the invention, an electronic trip unit, a so-called ETU, monitors an electric current in order to detect the presence of an electrical fault (short circuit, overcurrent, arc formation and the like). In the event of a fault being detected, the ETU excites a magnetic device which, because of the excitation, then trips a trip mechanism by means of a plunger. As a result of tripping, the trip mechanism disconnects from one another two contacts via which the current flows. As a result, the flow of current is interrupted by the power circuit breaker when there is an electrical fault.

BRIEF DESCRIPTION OF THE DRAWINGS

The invention will be explained in more detail in the following text with reference to example embodiments. For this purpose, the single FIGURE shows a schematic illustration of an embodiment of the power circuit breaker of the invention. The examples illustrate preferred embodiments of the invention.

The FIGURE shows a power circuit breaker 10, by which the current intensity of a current I flowing in an electrical line 12 is monitored. For this purpose, the profile of the current intensity of the current I is observed and analyzed in a known manner by an ETU 14 of the power circuit breaker 10.

DETAILED DESCRIPTION OF THE EXAMPLE EMBODIMENTS

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The power circuit breaker of at least one embodiment of the invention now does not have the otherwise conventional one magnetic device, rather it additionally has at least one further magnetic device which is likewise able to be excited by the ETU and by means of which the trip mechanism is likewise able to be tripped.

The power circuit breaker of at least one embodiment of the invention affords the advantage that a redundant second magnetic device is provided, by which the trip mechanism can be tripped if the first magnetic device is faulty.

In this connection, it is now conceivable that both of the magnetic devices are excited at the same time in the event of a fault, with the result that, if one of the magnetic devices fails, the trip mechanism is tripped by the other. However, it has proven to be particularly expedient for the trip mechanism to be able to be tripped by way of only one of the two magnetic devices at a time. This affords the advantage that the functional capability of the second magnetic device can be tested without the power circuit breaker having to be brought out of the operation mode and into a test mode for this purpose.

It is particularly expedient for the magnetic devices in the power circuit breaker for this purpose each to be movable into a test position and for the respective magnetic device which is in the test position to be able to be excited by the ETU without said magnetic device tripping the trip mechanism as a result. This affords the advantage that the magnetic device never has to be removed even for a mechanical test. Moreover, the ETU can be used to generate a trip signal.

In connection with a mechanical mounting of the magnetic devices and a controlled movement of same, one advantageous embodiment of the power circuit breaker provides that the magnetic devices are arranged in a magazine or carousel, in which the magnetic devices are then movable into different positions.

It can be equally expedient not to move the magnetic devices, but rather to design a trip element in the trip mechanism, which trip element is to be acted on in order to trip the trip mechanism, to be movable between two positions. This affords the advantage that the magnetic devices, that is to say for example the electrical coil, the permanent magnet and the plunger, do not have to be moved in the power circuit breaker in order to test one of the magnetic devices and to bring the other into operational readiness. Instead, only the trip element of the trip mechanism, that is to say for example a plate, which the plunger hits, has to be pivoted between the two magnetic devices.

In order to move at least one of the magnetic devices and/or at least one element of the trip mechanism, one expedient embodiment of the power circuit breaker provides an electromechanical device for this purpose. In this way, an automated self-test of the power circuit breaker is made possible.

A further advantage in that regard results when a testing device independent of the trip mechanism is provided, and generates a test signal in the event of a plunger of one of the magnetic devices acting on a sensor element of the testing device. If, therefore, the magnetic device which is in the test position is excited, such that the plunger thereof would have to be moved as a result, the testing device can be used to test whether the plunger also actually performs the expected mechanical movement. By way of example, a light-sensitive barrier, a Hall sensor or a switch, in particular a micro switch, can be provided as the sensor element.

Preferably, the two magnetic devices are constructed in the same way. Then the power circuit breaker can still be operated according to regulations, even in the event that one of the magnetic devices is known to be faulty. Another embodiment of the power circuit breaker provides that the second magnetic device is only configured as an emergency device which, for example, requires power from a battery for correct operation.

Here provision would then have to be made for ensuring, in the event of a fault in the first magnetic device, that the second magnetic device is kept ready for tripping the trip mechanism only for a limited period until the first magnetic device has been repaired again.

In a further expedient embodiment of the power circuit breaker, a control device, which is designed to perform a self-test of the power circuit breaker at predetermined points in time, is provided. For this purpose, the control device generates a trip signal to excite one of the magnetic devices.

Then, a test signal is generated depending on a mechanical behavior of the excited magnetic device. The control device can, for example, be formed in part by the described ETU and the testing device. By virtue of a testing device of this type being provided, information relating to whether there is at least one functioning magnetic device in the power circuit breaker is then advantageously available at all times. The control device can be coupled to a communication module of the power circuit breaker, with the result that the information can also be retrieved externally via a communication link.

In the event that an overcurrent, a short-circuit current or a current flow with another undesired profile is generated owing to an electrical fault in the line 12 or in an electrical load connected to the line 12, the ETU 14 generates an electrical trip signal in trip lines 16, whereupon a switch 18, via which the line 12 is guided, of the power circuit breaker 10 is opened. For this purpose, the trip signal of the trip lines 16 is conducted from a changeover device 20 to coil terminals 22, 24 of a magnetic device 26. The magnetic device 26 comprises an electrical coil 28, in which a plunger 30 is placed. As a result of the energization of the coil 28, as is effected by the trip signal, the magnetic device 26 becomes excited and, as a result, the plunger 30 is moved along a thrust direction 32 toward a trip element 34 of a trip mechanism 36. In this case, a spring (not shown) of the magnetic device 26 accelerates the plunger 30 even more. As soon as the plunger 30 meets the trip element 34, the trip mechanism 36 is tripped, that is to say the trip mechanism opens the switch 18 by way of a mechanical coupling 38.

A reliable functioning of the power circuit breaker 10 is ensured. For this purpose, the power circuit breaker 10 performs a self-test at regular intervals, during which self-test the mechanical functional capability of the components necessary for tripping the trip mechanism 36 is also tested. In this way, it is ensured that, when a trip signal is present in the lines 16, no mechanical problems such as jamming or freezing lead to the mechanical transfer of the signal for actuating the trip element 34 being blocked.

For the self-test, the power circuit breaker 10 has a second magnetic device 40 which, like the magnetic device 26, has an electrical coil 42 and a plunger 44, which is ejectable from the coil 42 in a thrust direction 46 by way of the coil 42 and a spring (not shown).

By way of the changeover device 20, the magnetic device 26 and the magnetic device 40 can be alternately brought into the operation position 48 in front of the trip element 34. The respective other magnetic device 26, 40 is then in a test position 50 in front of a testing device 52.

The FIGURE illustrates the case where the magnetic device 40 is in the test position 50. If the magnetic device 40 is excited here, such that it accelerates its plunger 44 in the thrust direction 46, this is detected by a sensor 54 of the testing device 52. The trip signal for exciting the magnetic device 40 in the test position 50 can likewise be generated by the ETU 14. For this purpose, the ETU 14 can also be connected to the testing device 52 and so the latter can be used to detect whether there is a trip signal from the ETU 14, with the result that the sensor 54 should register a movement of the plunger 44 if no fault is present. Depending on the mechanical behavior of the magnetic device to be tested in the position 50, that is to say in particular depending on a signal of the sensor 54, the testing device 52 generates a test signal in a communication link 56, which test signal is transmitted to an output device 58. If a fault arises in one of the magnetic devices in the test position 50, this can be for example optically or acoustically by means of the output device 58. The output device 58 can have a screen or a loudspeaker for this purpose. The output device 58 can be arranged in the power circuit breaker 10 itself. However, it can of course likewise be an external device, for example in a test bed of a larger system, in which the power circuit breaker 10 is installed. In this case, the communication link 56 can correspondingly be a wireless radio link or a network connection.

The changeover device 20 can be an electromechanical device, by which the magnetic devices 26, 40 can each be swapped between the operation position 48 and the test position 50. The two magnetic devices 26, 40 can be arranged on a carousel for this mechanical adjustment. The coil terminals 22, 24 and corresponding coil terminals 60, 62 of the magnetic device 40 can be configured as sliding contacts, for example. The changeover device 20 can, for example, be controlled by a control device 66, which can be realized by a microcontroller, for example.

As an alternative to a mechanical movement of the magnetic devices 26, 40, it can also be provided that, by way of the changeover device 20 via a mechanical coupling 68, the trip element 34 and the sensor 54 are moved between the two magnetic devices 26, 40, with the result that the trip element 34 is arranged in front of either the plunger 30 or the plunger 44 and correspondingly the sensor 54 is in front of the respective other plunger 30, 44.

The examples show how the power circuit breaker 10 makes it possible to monitor the entire signal path from the trip logic in the ETU 14 to the interface with the trip mechanism (that is to say with the trip element 34, which acts on the latching of the spring energy store of the trip mechanism 36), without the functional capability of the power circuit breaker 10 having to be negatively affected or even just limited. The power circuit breaker 10 can be used continuously to monitor the current I in the line 12.

By way of the control device 66, the changeover device 20 is controlled via control lines 70 at predetermined intervals of, for example, one day or one week, such that the positions 48, 50 of the magnetic devices 26, 40 or the positions of the trip element 34 and the sensor 54 can be swapped. Then the ETU 14 can be excited by the control device 66 to generate a trip signal for the magnetic device in the test position 50 (or for that magnetic device in front of which the sensor 54 is at that time).

As a result of this, the test signal is then generated by way of the testing device 52, which test signal is transmitted to the indicator device 58 by way of the communication link 56. Even in the event that the magnetic device which is being tested is discovered to be faulty during a test of this type, a further safe function of the power circuit breaker 10 is ensured however, since, immediately beforehand during the previous self-test, the functionality of that magnetic device which is now in the operation position or in front of which the trip element 34 is now situated has been tested. The testing device 52 can be, for example, an independent electronic circuit or a program of a microcontroller, for instance of that microcontroller which can also provide the functionality of the control device 66.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A power circuit breaker, in which an electronic trip unit (ETU) is configured to monitor an electric current in order to detect an electrical fault, comprising:

a first magnetic device configured to be excited in the event of a fault being detected, and when excited, configured to trip a trip mechanism via a plunger, the trip mechanism being configured to, when tripped, disconnect two contacts of the power circuit breaker via which the current flows;

a second magnetic device, configured to be excitable by the ETU, the second magnetic device being further configured to trip the trip mechanism, the first and second magnetic devices being movable into a test position and the one of the first and second magnetic devices which is in the test position is able to be excited by the ETU without said one magnetic device tripping the trip mechanism as a result; and a testing device, facing the second magnetic device, configured to generate a test signal in the event of a plunger of one of the first and second magnetic devices being detected by a sensor element of the testing device.

2. The power circuit breaker of claim 1, wherein the trip mechanism is trippable by only one of the first and second magnetic devices at one time.

3. The power circuit breaker of claim 1, wherein the first and second magnetic devices are movable into a test position and wherein the one of the first and second magnetic devices which is in the test position is able to be excited by the ETU without said one magnetic device tripping the trip mechanism as a result.

4. The power circuit breaker of claim 1, wherein the first and second magnetic devices are arranged in a magazine or a carousel, in which the first and second magnetic devices are movable into different positions.

5. The power circuit breaker of claim 1, wherein, in the trip mechanism, a trip element, which is to be acted on in order to trip the trip mechanism, is movable between two positions, in which, in each case, one of the first and second magnetic devices acts on the trip element when said one of the first and second magnetic devices is excited.

6. The power circuit breaker of claim 1, wherein at least one of the first and second magnetic devices and at least one element of the trip mechanism is movable by way of an electromechanical device.

7. The power circuit breaker of claim 1, wherein the second magnetic device is constructed in the same way as the first magnetic device.

8. The power circuit breaker of claim 1, further comprising:

a control device, designed to perform a self-test of the power circuit breaker at points in time and, configured to generate a trip signal to excite one of the first and second magnetic devices and then to generate a test signal in the event of a plunger of the excited one of the first and second magnetic devices acts on the sensor element of the testing device.

* * * * *